US007510262B2

(12) United States Patent
Tanaka

(10) Patent No.: US 7,510,262 B2
(45) Date of Patent: Mar. 31, 2009

(54) LIQUID EJECTION APPARATUS AND METHOD FOR FLUSHING OF LIQUID EJECTION APPARATUS

(75) Inventor: Ryoichi Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 436 days.

(21) Appl. No.: 11/390,156

(22) Filed: Mar. 28, 2006

(65) Prior Publication Data

US 2006/0244792 A1 Nov. 2, 2006

(30) Foreign Application Priority Data

Mar. 28, 2005 (JP) ..... 2005-092904
Aug. 9, 2005 (JP) ..... 2005-231009
Mar. 22, 2006 (JP) ..... 2006-078592

(51) Int. Cl.
*B41J 2/165* (2006.01)

(52) U.S. Cl. ..... 347/28; 347/35

(58) Field of Classification Search ..... 347/22, 347/28, 35

See application file for complete search history.

(56) References Cited

U.S. PATENT DOCUMENTS 7,246,877 B2 * 7/2007 Shindo ..... 347/35

FOREIGN PATENT DOCUMENTS

JP 9-52374 A 2/1997

* cited by examiner

*Primary Examiner*—An H. Do
(74) *Attorney, Agent, or Firm*—Sughrue Mion, PLLC

(57) ABSTRACT

A liquid ejection apparatus includes a liquid ejection head and a controller (CPU, ASIC). The liquid ejection head is mounted on a carriage that reciprocates and ejects liquid toward a target. The controller controls a flushing mode of an in-range flushing and a flushing mode of an out-of-range flushing when the liquid ejection head ejects liquid as the carriage reciprocates. The flushing mode of the in-range flushing is performed in a reciprocation range of the carriage outside the target during ejection performed by the liquid ejection head. The flushing mode of the out-of-range flushing is performed outside the reciprocation range of the carriage reciprocates during ejection performed by the liquid ejection head.

13 Claims, 11 Drawing Sheets

Ta1

| Marginless FL Interval T2 (sec) | Periodic FL Interval T1 (sec) |
|---|---|
| T2<0. 5 | 30 |
| 0. 5≦T2<1. 0 | 25 |
| 1. 0≦T2<2. 0 | 20 |
| 2. 0≦T2<5. 0 | 15 |
| 5. 0≦T2<10 | 10 |

Fig. 11

Ta2

| | | | Elapsed Time T4 (sec) | | | | | | |
|---|---|---|---|---|---|---|---|---|---|
| | | | A | B | C | D | E | F | G |
| | | | T4<5 | 5≦T4<10 | 10≦T4<15 | 15≦T4<20 | 20≦T4<25 | 25≦T4<30 | 30≦T4 |
| CR Stop Time T3 (sec) | 1 | T3<0. 5 | Marginless FL (0) | Marginless FL (0) | Marginless FL (1) | Marginless FL (1) | Marginless FL (1) | Marginless FL (1) | Periodic FL |
| | 2 | 0.5≦T3<1.0 | Marginless FL (1) | Marginless FL (1) | Marginless FL (2) | Marginless FL (2) | Marginless FL (2) | Periodic FL | Periodic FL |
| | 3 | 1.0≦T3<2.0 | Marginless FL (2) | Marginless FL (2) | Marginless FL (4) | Marginless FL (4) | Periodic FL | Periodic FL | Periodic FL |
| | 4 | 2.0≦T3<5.0 | Marginless FL (4) | Marginless FL (8) | Marginless FL (8) | Periodic FL | Periodic FL | Periodic FL | Periodic FL |
| | 5 | 5.0≦T3<10 | Marginless FL (4) | Marginless FL (8) | Periodic FL | Periodic FL | Periodic FL | Periodic FL | Periodic FL |

(k) ··· Flushing Frequency

Fig. 13

Ta3

| Marginless FL Interval T2 (sec) | Periodic FL Interval T1 (sec) | Number of Flushings/ Marginless FL k |
|---|---|---|
| T2<0. 5 | 30 | 1 |
| 0. 5≦T2<1. 0 | 25 | 2 |
| 1. 0≦T2<2. 0 | 20 | 4 |
| 2. 0≦T2<5. 0 | 15 | 8 |
| 5. 0≦T2<10 | 10 | — |

Fig. 14

Ta4

| | | | Elapsed Time T4 (sec) | | | | | | |
|---|---|---|---|---|---|---|---|---|---|
| | | | A | B | C | D | E | F | G |
| | | | T4<5 | 5≦T4<10 | 10≦T4<15 | 15≦T4<20 | 20≦T4<25 | 25≦T4<30 | 30≦T4 |
| CR Stop Time T3 (sec) | 1 | T3<0. 5 | Marginless FL (1) | Marginless FL (1) | Marginless FL (2) | Marginless FL (2) | Marginless FL (2) | Marginless FL (2) | Periodic FL |
| | 2 | 0.5≦T3<1.0 | Marginless FL (2) | Marginless FL (2) | Marginless FL (4) | Marginless FL (4) | Marginless FL (4) | Periodic FL | Periodic FL |
| | 3 | 1.0≦T3<2.0 | Marginless FL (4) | Marginless FL (4) | Marginless FL (8) | Marginless FL (8) | Periodic FL | Periodic FL | Periodic FL |
| | 4 | 2.0≦T3<5.0 | Marginless FL (8) | Marginless FL (8) | Periodic FL | Periodic FL | Periodic FL | Periodic FL | Periodic FL |
| | 5 | 5.0≦T3<10 | Marginless FL (8) | Periodic FL | Periodic FL | Periodic FL | Periodic FL | Periodic FL | Periodic FL |

(k) ··· Flushing Frequency

LIQUID EJECTION APPARATUS AND METHOD FOR FLUSHING OF LIQUID EJECTION APPARATUS

CROSS-REFERENCE TO RELATED APPLICATIONS

This application is based upon and claims the benefit of priority from prior Japanese Patent Application No. 2005-092904, filed on Mar. 28, 2005; Japanese Patent Application No. 2005-231009, filed on Aug. 9, 2005; and Japanese Patent Application No. 2006-078592, filed on Mar. 22, 2006, the entire contents of which are incorporated herein by reference.

BACKGROUND OF THE INVENTION

The present invention relates to a liquid ejection apparatus and a method for flushing a liquid ejection apparatus.

An inkjet printer (hereafter simply as a "printer") is widely known as a liquid ejection apparatus for ejecting liquid toward a target. The printer has a recording head (a liquid ejection head) mounted on a carriage, which reciprocates. Ink is supplied to the recording head and ejected from nozzles of the recording head. In this way, the printer performs printing on a recording medium, which serves as a target. However, the printer may have the following problem. The ink solvent evaporates through the nozzles of the recording head. This increases the viscosity of the ink or solidifies the ink. As a result, the nozzles become clogged, and printing failures occur.

To solve this problem, the printer typically performs a flushing operation for forcibly ejecting the ink in the nozzles (refer, for example, to Japanese Laid-Open Patent Publication No. 9-52374) irrespective of the ejection toward the target. The flushing operation is performed after the carriage, on which the recording head is mounted, moves to a capping unit (cleaning mechanism) or an ink reception portion used exclusively for flushing. The capping unit and the ink reception portion are arranged in a non-print area. The flushing operation is performed whenever a predetermined time (e.g., twenty seconds) elapses so that the ink in the nozzles does not increase viscosity or does not solidify.

However, the non-print area in which the capping unit and the ink reception portion that perform the above-described flushing are distanced from a print area in which paper is arranged. To perform flushing during printing, the carriage (and the recording head) must be moved from the print area to the non-print area. Such movement of the carriage may prolong the printing process time. This may lower the printing efficiency.

SUMMARY OF THE INVENTION

It is an object of the present invention to provide a liquid ejection apparatus for efficiently performing a flushing operation and a method for flushing a liquid ejection apparatus.

A first aspect of the present invention provides a liquid ejection apparatus for ejecting liquid toward a target. The apparatus includes a liquid ejection head, mounted on a carriage that reciprocates, for ejecting the liquid toward the target. A controller controls a flushing mode of an in-range flushing, performed during the ejection by the liquid ejection head in a reciprocation range of the carriage outside the target, and a flushing mode of an out-of-range flushing, performed during the ejection by the liquid ejection head outside the reciprocation range of the carriage when the liquid ejection head ejects the liquid as the carriage reciprocates.

A second aspect of the present invention provides a method for flushing of a liquid ejection apparatus having a liquid ejection head, mounted on a carriage that reciprocates, for ejecting liquid toward a target. The method includes determining a parameter for determining a flushing mode of an in-range flushing, performed during the ejection by the liquid ejection head in a reciprocation range outside the target, and a parameter for determining a flushing mode of an out-of range flushing, performed during the ejection by the liquid ejection head in the reciprocation range of the carriage. The method also includes performing both of the flushing mode of the in-range flushing and the flushing mode of the out-of range flushing by associating the parameter for determining the flushing mode of the in-range flushing and the parameter for determining the flushing mode of the out-of range flushing.

BRIEF DESCRIPTION OF THE DRAWINGS

The invention, together with objects and advantages thereof, may best be understood by reference to the following description of the presently preferred embodiments together with the accompanying drawings in which:

FIG. 11 is a management table showing modes of flushing that are set based on the carriage stop time and the elapsed time;

FIG. 13 shows a management table showing the correspondence between the marginless flushing interval, the periodic flushing interval, and the flushing frequency per marginless flushing operation in a modification of the first embodiment; and FIG. 14 shows a management table showing modes of flushing that are set based on the carriage stop time and the elapsed time in a modification of the third embodiment.

DETAILED DESCRIPTION OF THE PREFERRED EMBODIMENTS

An on-carriage type printer according to a first embodiment of the present invention will now be described with reference to FIGS. 1 to 8. In the following description, printing performed over the entire print surface of a paper, which serves as a target, is referred to as "marginless printing". Marginless printing is enabled by ejecting ink droplets to areas beyond the edges of the paper. A paper on which marginless printing is performed normally has no margins on its print surface. Although a paper may have a margin on part of its print surface depending on the print data, such printing is still referred to as marginless printing as long as any part of the range in which ink droplets are ejected extends beyond the edge of the paper.

Figure 1:
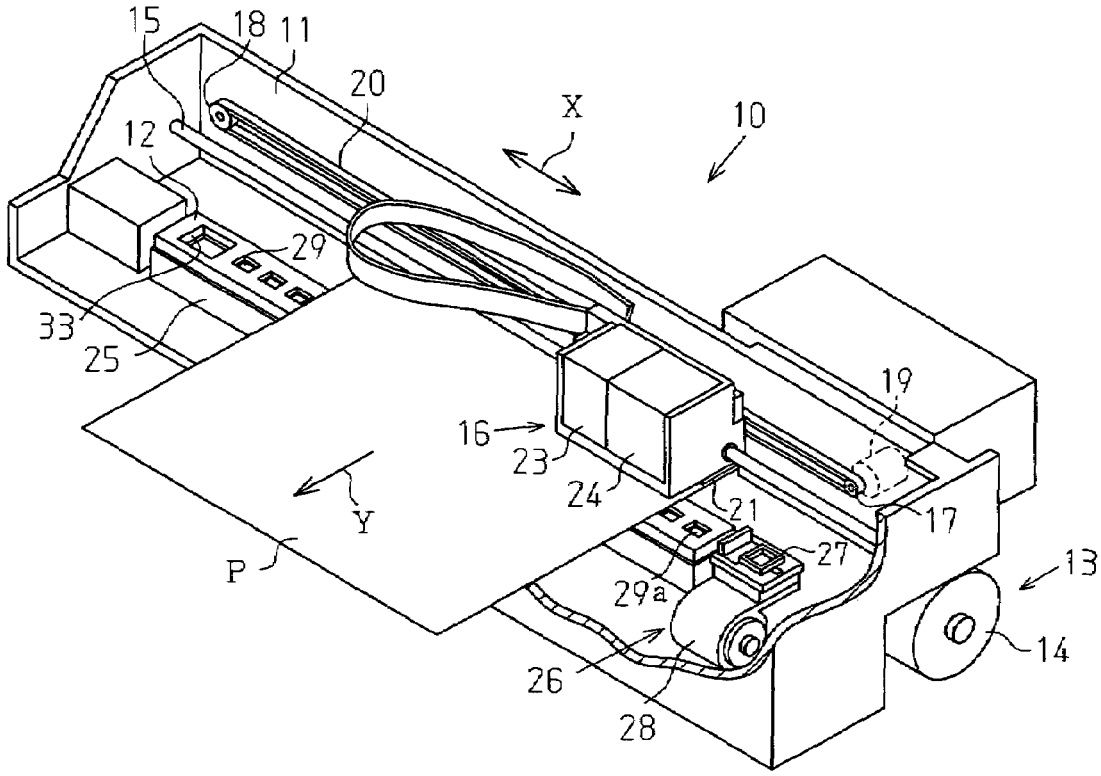
FIG. 1 is a perspective view of a printer according to first to third embodiments of the present invention.

As shown in FIG. 1, a printer 10 serving as a liquid ejection apparatus of the present embodiment has a frame 11, which is generally box-shaped. In the frame 11, a platen 12 is arranged at a lower portion of the frame 11 to extend in the longitudinal direction of the frame 11 (the main scanning direction X in FIG. 1). The platen 12 is a support base for supporting a paper P, which serves as a target. The platen 12 transports the paper P in the transportation direction Y, which is perpendicular to the main scanning direction X, based on a drive force produced by a paper feed motor 14 included in a paper feed mechanism 13.

In the frame 11, a guide rod 15 is arranged over the platen 12. The guide rod 15, which is inserted through the carriage 16, movably supports the carriage 16. A drive pulley 17 and a driven pulley 18 are rotatably supported on the inner surface of the frame 11 at positions corresponding to the two ends of the guide rod 15, respectively. A carriage motor 19 is connected to the drive pulley 17. A timing belt 20, which is wound around the two pulleys 17 and 18, fixes and supports the carriage 16. When the carriage motor 19 is driven, the carriage 16 is guided by the guide rod 15 and is moved in the main scanning direction X by the timing belt 20.

Figure 2:
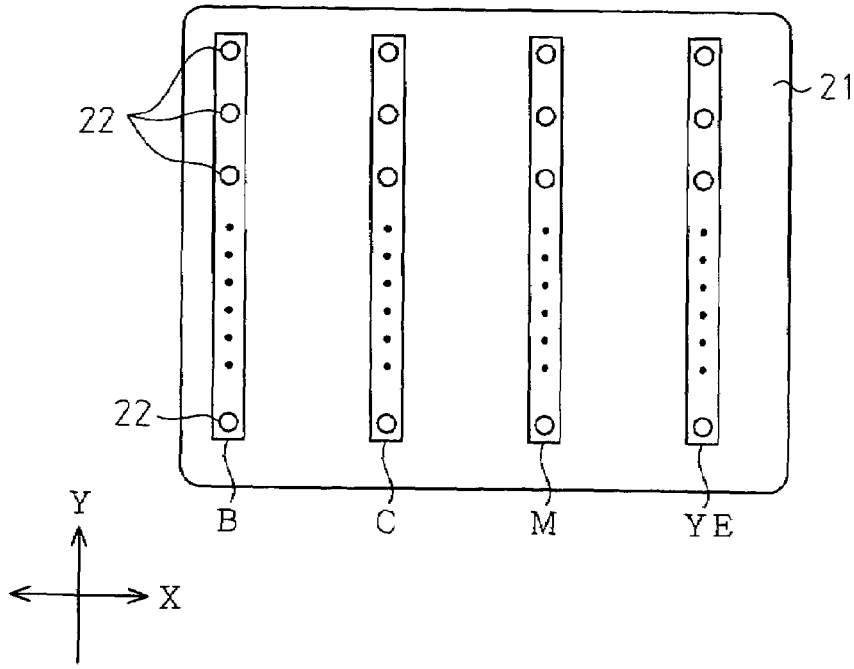
FIG. 2 is a bottom view showing a recording head.

As shown in FIG. 1, a recording head 21 serving as a liquid ejection head is arranged on the lower surface of the carriage 16. As shown in FIG. 2, a black ink nozzle group B, a cyan ink nozzle group C, a magenta ink nozzle group M, and a yellow ink nozzle group YE are formed on the lower surface of the recording head 21. Each of the nozzle groups B, C, M, and YE includes a plurality of (180 in the present embodiment) nozzles 22 for ejecting ink of the corresponding color. The nozzles of each of the nozzle groups B, C, M, and YE are aligned at a regular interval (nozzle pitch) in the transportation direction.

The recording head 21 further includes a piezoelectric device (not shown) for each nozzle 22. The piezoelectric devices are driven to control ink (liquid) that is ejected from the nozzles 22 toward the paper P, which is arranged under the recording head 21. Ink cartridges 23 and 24 for supplying ink to the recording head 21 are detachably mounted on the carriage 16.

In the frame 11, a disposal liquid tank 25 is arranged under the platen 12 extending parallel to the platen 12. The disposal liquid tank 25 accommodates an absorption member (not shown), which is made, for example, of porous pulpwood. During cleaning or wiping as known in the art, ink is discharged into the disposal liquid tank 25 and absorbed by the absorption member.

A cleaning mechanism 26 is arranged at one end of the printer 10 (right end in FIG. 1), which is in a non-print area which the paper P does not reach. The cleaning mechanism 26 draws in the residual ink in the nozzles 22, and prevents the nozzles 22 from being clogged. As shown in FIG. 1, the cleaning mechanism 26 includes a cap 27 and a suction pump 28. The cap 27 seals the recording head 21. The cap 27 is lifted and lowered by a known lifting and lowering member (not shown). When the cap 27 is lifted, the cap 27 comes in contact with the recording head 21 and seals the nozzles 22 (nozzle formation surface) of the recording head 21.

As shown in FIGS. 4A to 4E and FIG. 5, the platen 12 has a plurality of grooves 29. Projections 31 are formed between the grooves 29. An ink absorption member 32 is arranged in each of the grooves 29. The projections 31 are formed so that the projections 31 come in contact with the paper P that is supported on the platen 12 and so that ink does not bombard the projections 31 during marginless printing. As a result, the ink absorption members 32 arranged in the grooves 29 absorb ink ejected to an area extending beyond the width of the paper P (over-bombardment area) during marginless printing. In the same manner, the ink absorption members 32 arranged in the grooves 29 absorb ink ejected during marginless flushing (in-range flushing), which is performed above the grooves 29. The marginless flushing is one mode of flushing that is performed in an area beyond the edge of the "paper P within a reciprocation range S (in a print area) in which the carriage 16 (the recording head 21) reciprocates during marginless printing. The marginless flushing is performed irrespectively of printing. The marginless flushing is performed in a period between when the carriage 16 starts accelerating and when marginless printing is started and during a period between when marginless printing ends and when the carriage 16 stops moving. In other words, the marginless flushing is performed when the carriage 16 is accelerating or decelerating. Although such marginless flushing is advantageous in that it does not affect the printing process time, the marginless flushing is performed for only a short distance and flushes only a small amount of ink (only a small amount is ink is ejected). The marginless flushing thus cannot sufficiently prevent the ink in the nozzles of the recording head 21 from increasing viscosity or solidifying. Another mode of flushing performed in an area that is out of the reciprocation range S (non-print area), in which the carriage 16 (the recording head 21) reciprocates during marginless printing, is referred to as periodic flushing (out-of-range flushing). The marginless flushing and the periodic flushing will be described in detail later.

An ink reception portion 33, which is a recess, is arranged at one end of the platen 12 (left end in FIG. 4). The ink reception portion 33 is formed at a position lower than the bottom surfaces of the grooves 29. An ink absorption member 34 is arranged in the ink reception portion 33 in the same manner as in the grooves 29. The ink reception portion 33 is positioned outside the carriage reciprocation range S, in which the carriage 16 (the recording head 21) reciprocates during marginless printing. The carriage 16 is moved to a position above the ink reception portion 33 when the periodic flushing is performed. When the carriage 16 is located above the ink reception portion 33, drive signals irrespective of printing are applied to the piezoelectric devices in the recording head 21 so that ink is ejected from the nozzles 22. The ejected ink is absorbed by the ink absorption member 34, which is arranged in the ink reception portion 33. As shown in FIGS. 4A to 4E, the ink reception portion 33 has substantially the same size as the nozzle opening surface of the recording head 21. Thus, the periodic flushing ejects a sufficient amount of ink and prevents ink in the nozzles of the recording head 21 from increasing viscosity or solidifying.

Figure 3:
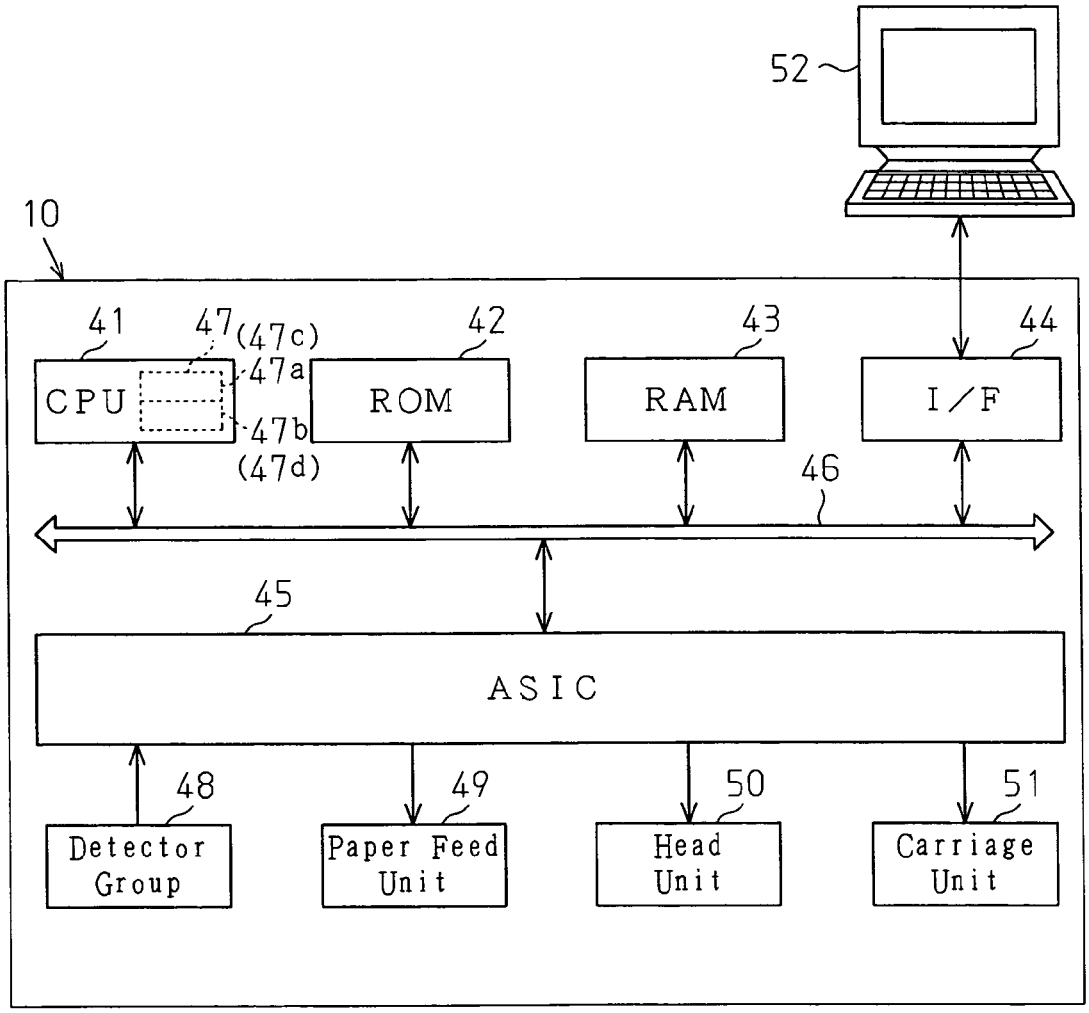
FIG. 3 is a block diagram showing the overall structure of the printer.

FIG. 3 is a block diagram showing the electric structure of the printer 10. The printer 10 includes a CPU 41 serving as a controller, a ROM 42 serving as a storage portion, a RAM 43, an I/F 44, and an ASIC 45 serving as a controller. These devices are electrically connected by a bus 46. The CPU 41 incorporates a timer 47 and executes the main control of the printer 10. The CPU 41 operates based on control programs stored in the ROM 42 and uses the RAM 43 as its work area.

The timer 47 in the present embodiment has a periodic flushing timer 47*a* serving as an out-of-range flushing timer and a marginless flushing timer 47*b* serving as an in-range flushing timer. The periodic flushing timer 47*a* measures a periodic flushing interval T1 for performing the periodic flushing. The marginless flushing timer 47*b* measures a marginless flushing interval T2 for performing the marginless flushing. A detector group 48, a paper feed unit 49, a head unit 50, and a carriage unit 51 are connected to the ASIC 45.

The detector group 48 includes a linear encoder, a rotary encoder, and various sensors such as a paper detection sensor and an optical sensor (none shown). The linear encoder detects the position of the carriage 16 in the movement direction. The rotary encoder detects the amount of rotation of a transportation roller (not shown). The paper detection sensor detects the position of the top of the paper P on which printing is performed. The optical sensor includes a light-emitting portion, which irradiates the paper P with light, and detects reflected light from the paper P with a light-receiving portion. As a result, the optical sensor detects whether or not a piece of paper P has been set.

The paper feed unit 49 places the paper P as a printing medium at a printable position. During printing, the paper feed unit 49 feeds the paper P by a predetermined transportation amount in the transportation direction Y. The paper feed unit 49 includes the paper feed mechanism 13 and the platen 12. The head unit 50 includes the recording head 21 and ejects ink onto the paper P. The recording head 21, when moving in the main scanning direction X, intermittently ejects ink from the nozzles 22. The carriage unit 51, which includes the carriage 16 and the carriage motor 19, moves the recording head 21 in the main scanning direction X.

The printer 10 is connected to a host computer 52 via the I/F 44. The host computer 52 includes a printer driver (not shown). Software is installed in the printer driver, and the software transmits commands to various parts of the printer 10 to perform operations including printing and flushing. The CPU 41 and the ASIC 45 operate in accordance with the software installed in the printer driver and controls the printing and flushing operations of the recording head 21 of the head unit 50 or the operations of the carriage 16 of the carriage unit 51 and the paper feed motor 14 of the paper feed unit 49.

The operation of the printer 10 will now be described focusing on the periodic flushing and the marginless flushing. In the present embodiment, the two modes of flushing, or the periodic flushing and the marginless flushing, are performed during marginless printing.

FIGS. 4A to 4E schematically show marginless printing. When marginless printing is started, the carriage 16 repeats reciprocation (in the reciprocation range S) between a stop position shown in FIG. 4A prior to a printing process and a stop position shown in FIG. 4E subsequent to a dot formation process shown in FIGS. 4B to 4D until printing is completed. The processes shown in FIGS. 4A to 4E will now be described in detail.

Figure 4A:
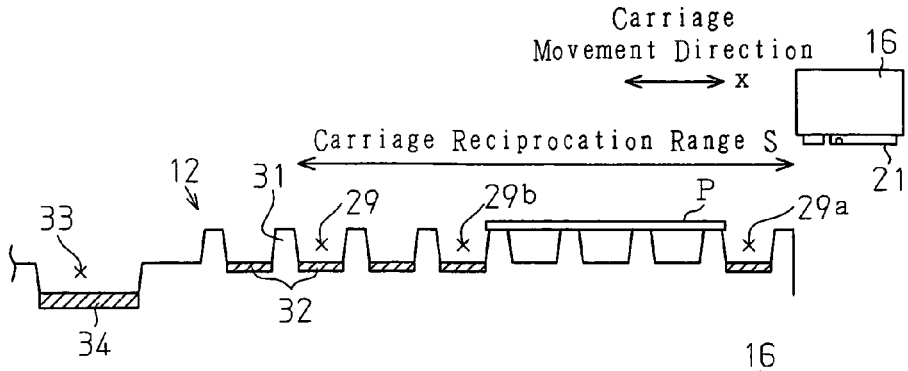
FIG. 4A is a diagram schematically showing marginless printing.
Figure 4B:
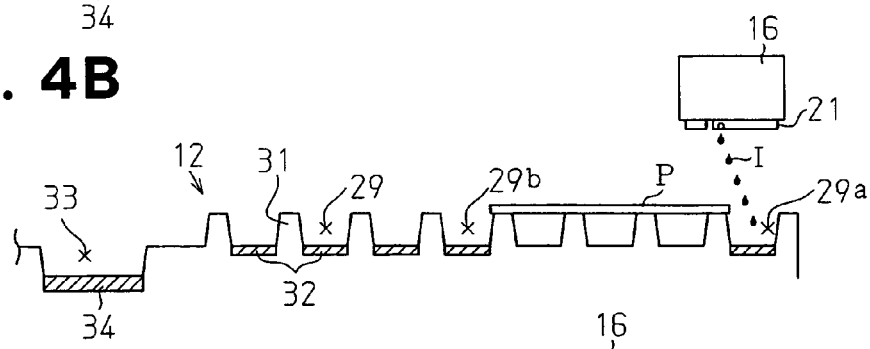
FIG. 4B is a diagram schematically showing marginless printing.
Figure 4C:
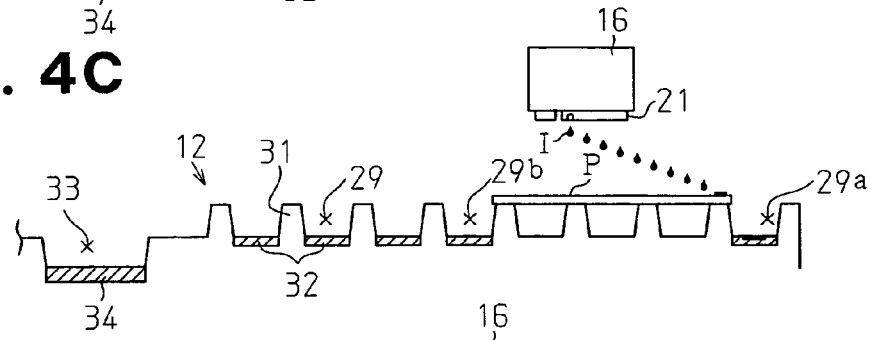
FIG. 4C is a diagram schematically showing marginless printing.
Figure 4D:
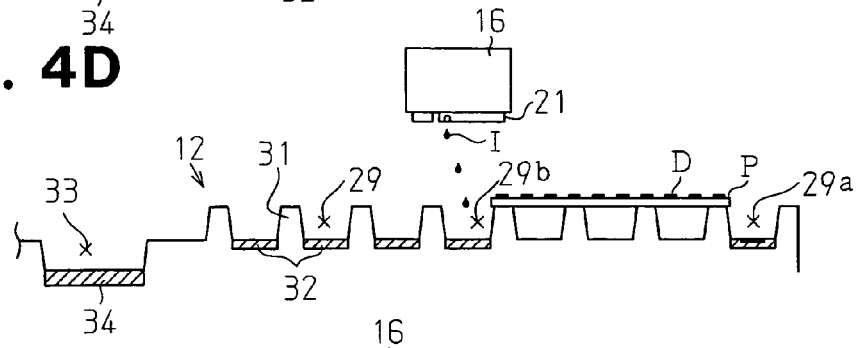
FIG. 4D is a diagram schematically showing marginless printing.
Figure 4E:
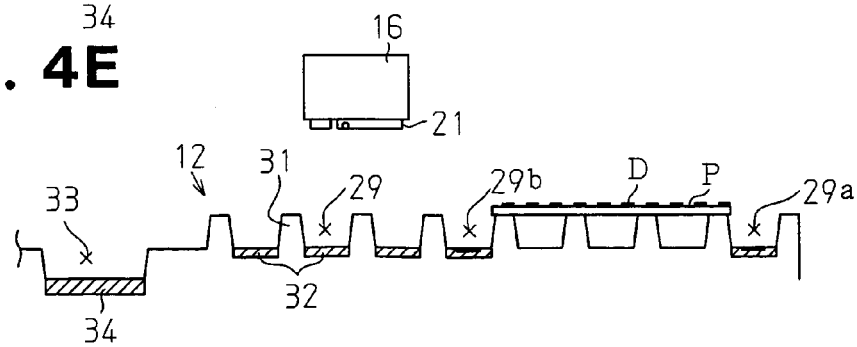
FIG. 4E is a diagram schematically showing marginless printing.

Before the printing process is started, the carriage 16 is stopped at a position located beyond the right end of the paper P (position at which the recording head 21 does not face the paper P) as shown in FIG. 4A. When marginless printing is started, the carriage 16 moves to the left as viewed in FIG. 4A as it accelerates. As shown in FIG. 4B to 4D, the carriage 16 continues to move forth while ejecting ink droplets I from the recording head 21. The ejected ink droplets I bombard the paper P and form dots D, which constitute an image that is printed on the paper P. In this way, marginless printing is performed by ejecting ink over an area that is larger than the paper P.

FIG. 4B shows a state in which the carriage 16 has started accelerating but has not yet reached the paper P, and the recording head 21 is located above a right-end groove 29*a*. The marginless flushing is performed when the recording head 21 is located at this position. More specifically, the groove 29*a*, which receives the ink failing to reach the paper P during marginless printing, receives the ink that is ejected by the flushing operation. In other words, the groove 29*a*, which receives the ink failing to reach the paper P during marginless printing, also functions as a ink reception portion for receiving the ink that is ejected by the flushing operation. The recording head 21 shown in FIG. 2 has the nozzle groups B, C, M, and YE, which are arranged in this order in the movement direction of the carriage 16. Thus, the black ink is flushed when the black ink nozzle group B is positioned above the groove 29*a*. The cyan ink is flushed when the cyan ink nozzle group C is positioned over the groove 29*a*. The same manner applies to the magenta ink nozzle group M and the yellow ink nozzle group YE.

FIG. 4D shows a state in which the carriage 16 has completed the dot formation process and starts decelerating but has not yet reached the stop position beyond the paper P and the recording head 21 is arranged above the groove 29*b* located at the left end of the paper P. In the present embodiment, the marginless flushing described above may also be performed when the recording head 21 is located at this position. The ROM 42 prestores the marginless flushing interval T2, which is an interval at which the marginless flushing is performed. In this way, the marginless flushing is performed in the reciprocation range S of the carriage 16 during marginless printing.

Figure 5:
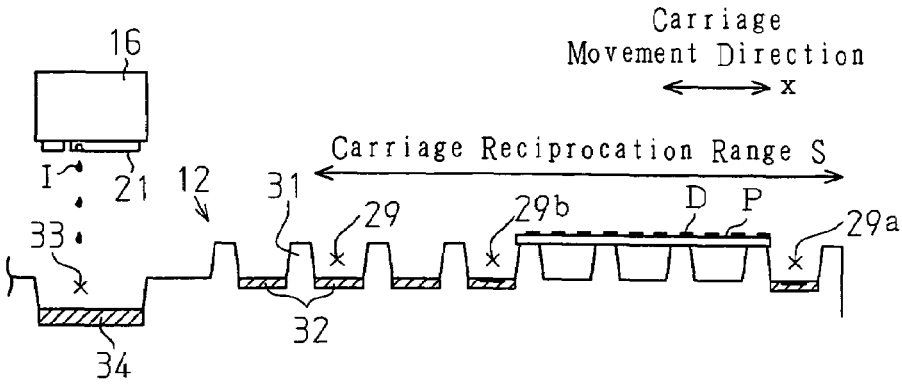
FIG. 5 is a diagram showing periodic flushing.

FIG. 5 schematically shows the periodic flushing. As shown in FIG. 5, the periodic flushing is performed when the carriage 16 is located outside the reciprocation range S of the dot formation process and the recording head 21 is arranged above the ink reception portion 33. The periodic flushing is performed periodically whenever a predetermined time elapses during marginless printing. In this way, the periodic flushing is performed when the carriage 16 is located outside the reciprocation range S during marginless printing. Thus, the periodic flushing interrupts the printing process and requires the carriage 16 to be moved to the position above the ink reception portion 33. Thus, the periodic flushing prolongs the printing process time more than the marginless flushing described above.

The control for marginless printing in the present embodiment will now be described with reference to the flowcharts shown in FIGS. 6 and 7. The ROM 42 prestores a management table Ta1 showing the correspondence between the marginless flushing interval T2 and the periodic flushing interval T1 as shown in FIG. 8. In other words, the management table Ta1 associates the periodic flushing interval T1, which is one parameter for determining a mode of the periodic flushing, with the marginless flushing interval T2, which is one parameter for determining a mode of the marginless flushing. The marginless flushing interval T2 does not change throughout the print operation of the same piece of paper P.

In the present embodiment, the periodic flushing interval T1 becomes shorter as the marginless flushing interval T2 becomes longer as shown in FIG. 8. For example, when the marginless flushing interval T2 is less than 0.5 second, the periodic flushing interval T1 is set at 30 seconds. When the marginless flushing interval T2 is greater than or equal to 0.5 second and less than 1.0 second, the periodic flushing interval T1 is set to be less than 30 seconds, more specifically, 25 seconds. This setting is due to the following reason. When the marginless flushing interval T2 is short, the marginless flushing is frequently performed. Thus, the marginless flushing ejects a sufficient amount of ink, and there would be no problem even if the periodic flushing interval T1 is set to be long such that the periodic flushing is performed less frequently. Further, the periodic flushing process shown in FIG. 6 and the marginless flushing process shown in FIG. 7 are performed in parallel in the present embodiment. The periodic flushing interval is set at 10 seconds when the marginless flushing is not performed. When the marginless flushing is performed, the periodic flushing interval may be extended to a maximum of 20 seconds.

Figure 6:
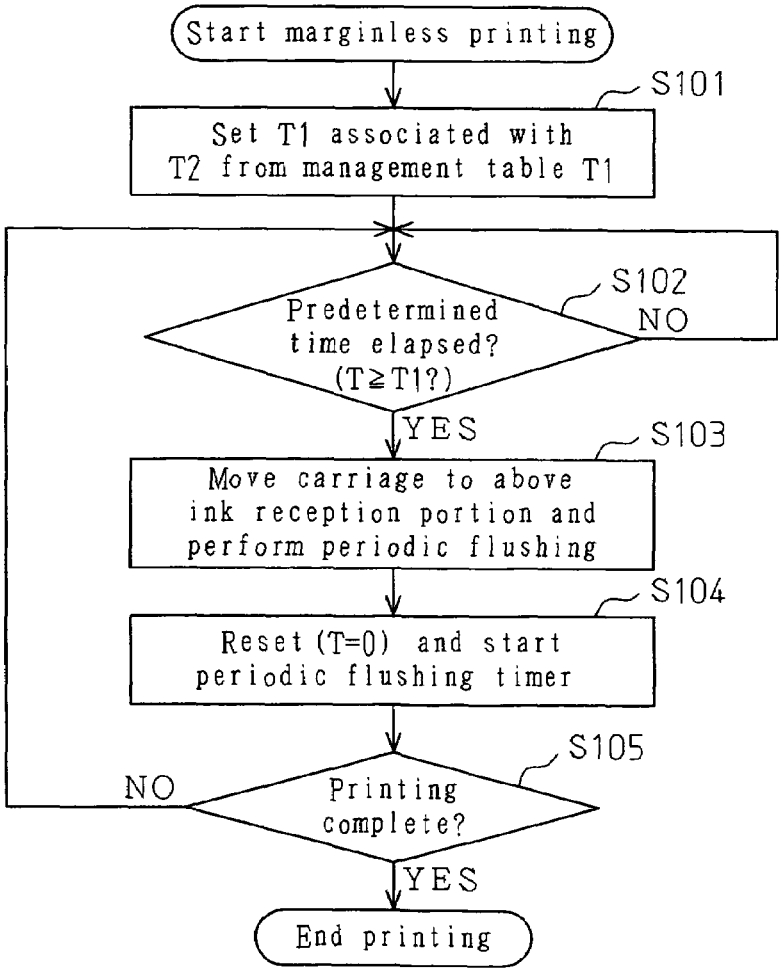
FIG. 6 is a flowchart showing the control for periodic flushing in the first embodiment.
Figures 7, 8:
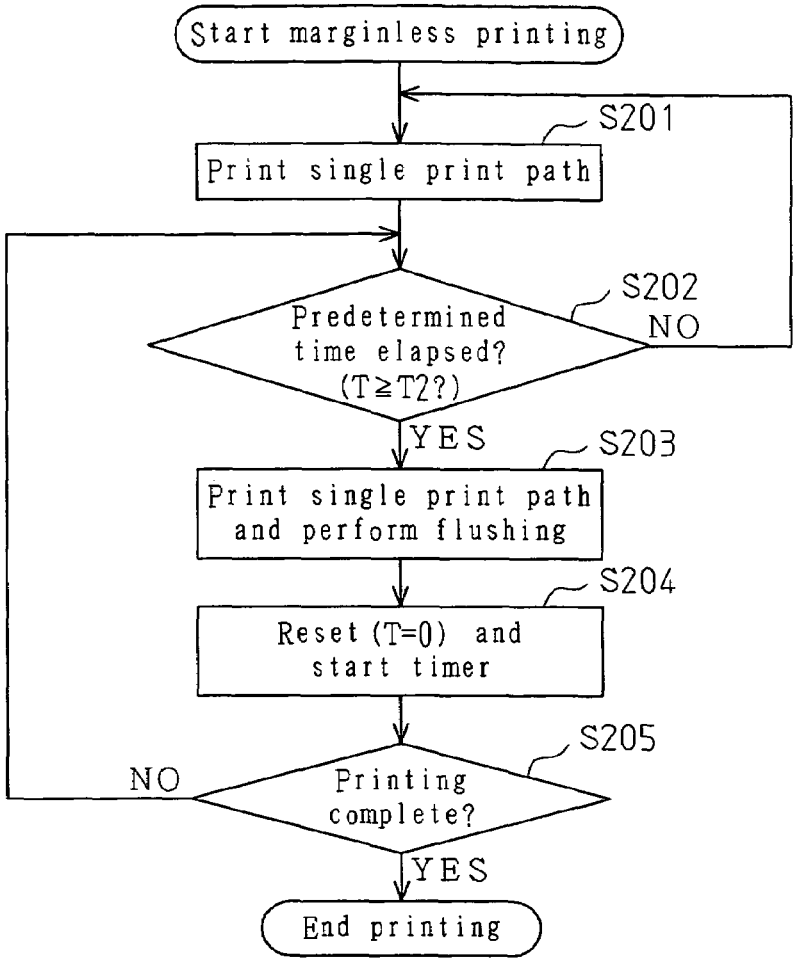
FIG. 7 is a flowchart showing the control for marginless flushing;.
FIG. 8 is a management table showing the correspondence between the marginless flushing interval and the periodic flushing interval.

FIG. 6 is a flowchart showing the periodic flushing process that is performed during marginless printing. As shown in FIG. 6, when marginless printing is started, the CPU 41 (and the ASIC 45) sets the periodic flushing interval T1 corresponding to the preset marginless flushing interval T2. (step S101). Next, the CPU 41 (and the ASIC 45) obtains data on the elapsed time T from the periodic flushing timer 47*a* and determines whether the predetermined time has elapsed (T≧T1?) (S102). When the predetermined time has not elapsed (S102: NO), this step is repeated until the predetermined time elapses. When the predetermined time has elapsed (S102: YES), the carriage 16 (the recording head 21) is moved to a position above the ink reception portion 33 (refer to FIG. 5) and the periodic flushing is performed (S103). Then, the periodic flushing timer 47*a* is reset (T=0) so that the periodic flushing timer 47*a* restarts counting the elapsed time T, which will be compared with the periodic flushing interval T1 (S104). Next, the CPU 41 (and the ASIC 45) determines whether printing has been completed (S105). When printing has been completed (S105: YES), the periodic flushing process ends. When printing has not been completed (S105: No), the processing returns to the determination as to whether the predetermined time has elapsed (S102) so as to repeat the routine.

FIG. 7 is a flowchart showing the marginless flushing process that is performed during marginless printing. As shown in FIG. 7, when marginless printing is started, the printing of a single print path is performed (S201). Next, the CPU 41 (and the ASIC 45) obtains data on the elapsed time T from the marginless flushing timer 47*b* and determines whether the predetermined time has elapsed (T≧T2?) (S202). When the predetermined time has not elapsed (S202: NO), the printing of the next single print path is performed (S201). This step is repeated until the predetermined time elapses. When the predetermined time has elapsed (S202: YES), while the printing of the next single path is being performed, the marginless flushing is simultaneously performed (S203). The marginless flushing is performed while the carriage 16 is decelerating as shown in the state of FIG. 4D after the dot formation process is completed. Alternatively, the marginless flushing may be performed while the carriage 16 is accelerating as shown in the state of FIG. 4B immediately before the dot formation process is started.

After the marginless flushing is performed, the marginless flushing timer is reset (T=0) and the marginless flushing timer restarts counting the elapsed time T, which will be compared with the flushing interval T2 (S204). Next, the CPU 41 (and the ASIC 45) determines whether printing has been completed (S205). When printing has been completed (S205: Yes), the marginless flushing process ends. When printing has not been completed (S205: No), the processing returns to the determination as to whether the predetermined time has elapsed (S202) so as to repeat the routine.

As described above, the periodic flushing interval T1 is set in accordance with the marginless flushing interval T2 in the present embodiment. In other words, the marginless flushing interval T2 is a parameter for setting the periodic flushing interval T1.

The first embodiment has the advantages described below.

(1) In the above embodiment, the marginless flushing and the periodic flushing are performed in combination during marginless printing. Although the marginless flushing alone may not be able to sufficiently prevent the ink in the nozzles 22 of the recording head 21 from increasing viscosity or from solidifying, the marginless flushing and the periodic flushing in combination sufficiently prevents the ink from increasing viscosity or from solidifying. As a result, printing deficiencies are reduced. Further, when the marginless flushing is performed, the periodic flushing interval may be extended. This reduces the number of times the carriage 16 (the recording head 21), which is in the reciprocation range S during marginless printing, to move all the way to the ink reception portion 33, which is outside the reciprocation range S. As a result, the flushing efficiency is improved, and the printing process time is shortened.

(2) In the above embodiment, the ROM 42 stores data associating a longer marginless flushing interval T2 with a shorter periodic flushing interval T1. When the marginless flushing interval T2 is long, the marginless flushing is less likely to enable a sufficiently large amount of ink to be ejected as compared with when the marginless flushing interval T2 is short. In the present embodiment, the periodic flushing interval T1 is set short when the marginless flushing interval T2 is long so that the periodic flushing is performed frequently to eject a sufficiently large amount of ink.

A second embodiment of the present invention will now be described with reference to FIG. 9. The printer 10 of the second embodiment has the same main structure as that in the first embodiment and will not be described. The second embodiment will be described focusing on the control differing from the control in the first embodiment. In the first embodiment described above, the ROM 42 prestores the data showing the correspondence between the marginless flushing interval T2 and the periodic flushing interval T1 (refer to FIG. 8). In the second embodiment, the ROM 42 does not store the data shown in FIG. 8, and the periodic flushing interval T1 is set in accordance with whether or not the marginless flushing has been performed. Hence, the CPU 41 does not have the marginless flushing timer 47*b*.

Figure 9:
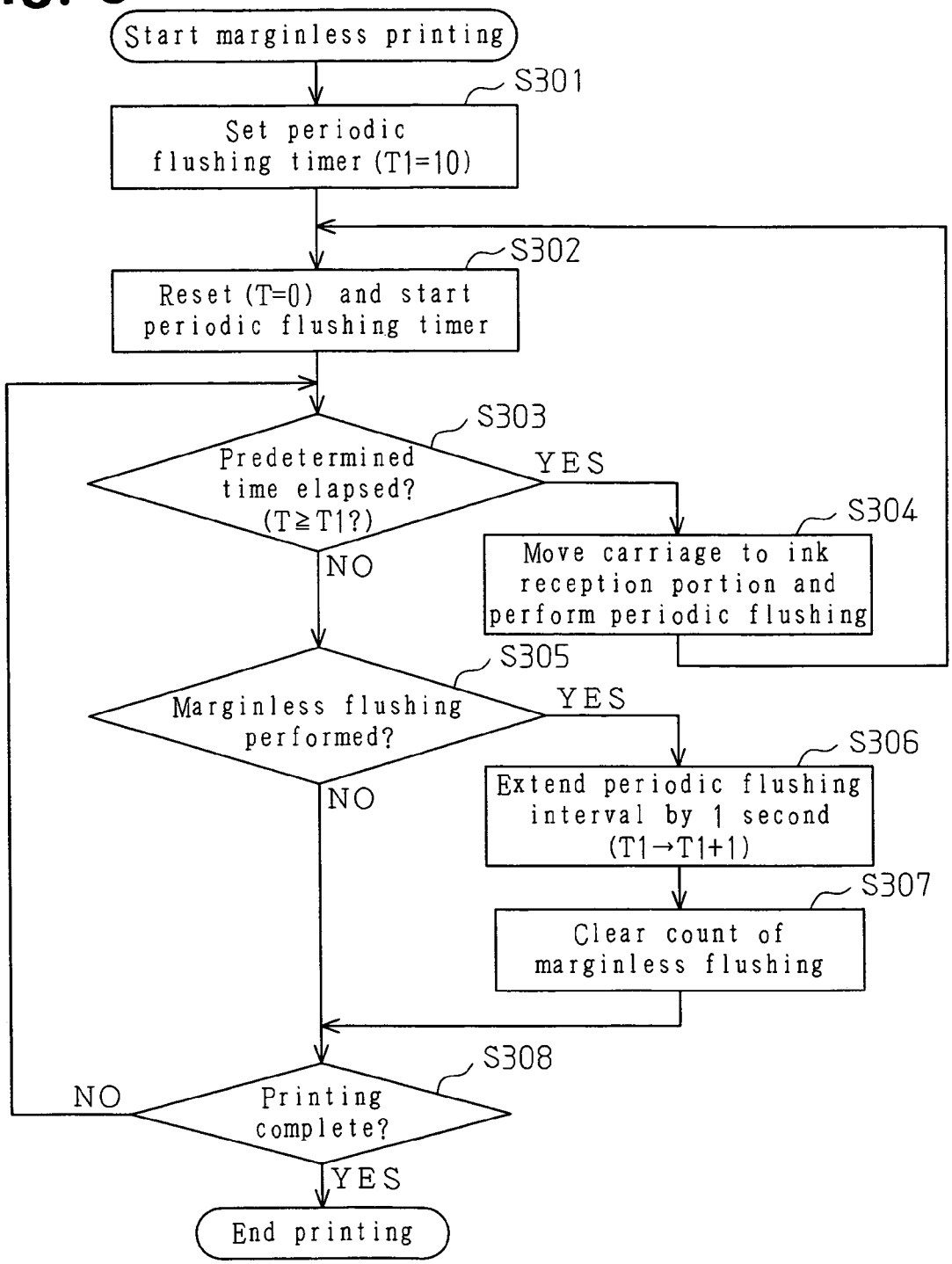
FIG. 9 is a flowchart showing the control for marginless flushing and periodic flushing in the second embodiment.

FIG. 9 is a flowchart showing the marginless flushing and periodic flushing processes that are performed during marginless printing in the second embodiment. As shown in FIG. 9, when marginless printing is started, the CPU 41 (and the ASIC 45) sets the periodic flushing interval T1, which is measured by the periodic flushing timer 47*a*, at a specified value of 10 seconds (S301). Next, the periodic flushing timer 47*a* starts counting the elapsed time T, which is compared with the periodic flushing interval T1 (S302). If the periodic flushing timer 47*a* still has the previously counted elapsed time T (when step S302 is performed after step S304 is performed), the periodic flushing timer 47*a* is reset (T=0), and the periodic flushing timer 47*a* restarts counting the elapsed time T. Next, the CPU 41 (and the ASIC 45) obtains data on the elapsed time T from the periodic flushing timer 47*a* and determines whether the predetermined time has elapsed (T≧T1?) (S303). When the predetermined time has elapsed (S303: YES), the carriage 16 (the recording head 21) is moved to a location above the ink reception portion 33 (refer to FIG. 5), and the periodic flushing is performed (S304). Then, the periodic flushing timer 47*a* is reset (T=0), and the periodic flushing timer 47*a* restarts counting the elapsed time T (S302).

When the predetermined time has not elapsed (S303: No), the CPU 41 (and the ASIC 45) determines whether the marginless flushing has been performed during the elapsed time T (S305). When the marginless flushing has been performed (S305: YES), the periodic flushing interval T1 measured by the periodic flushing timer 47*a* is extended by one second (S306). Then, the counted number of times the marginless flushing has been performed is cleared (S307). Next, the CPU 41 (and the ASIC 45) determines whether printing has been completed (S308). When printing has been completed (S308: YES), the flushing processes end. When printing has not been completed (S308: NO), the processing returns to the determination as to whether the predetermined time has elapsed (S303), and the routine is repeated. When the marginless flushing has not been performed (S305: NO), the CPU 41 (and the ASIC 45) determines whether printing has been completed (S308). The subsequent processing is the same as the processing described above.

In the present embodiment described above, the periodic flushing interval T1 is extended by one second whenever the marginless flushing has been performed during the elapsed time T. In other words, the number of times the marginless flushing has been performed serves as a parameter for setting the periodic flushing interval T1.

The second embodiment has the advantages described below in addition to advantage (1) in the first embodiment.

(3) In the above embodiment, the periodic flushing interval T1 is set in accordance with whether the marginless flushing has been performed. When the marginless flushing is performed frequently, the marginless flushing enables a sufficiently large amount of ink to be ejected as compared with when the marginless flushing is performed less frequently. In this case, the periodic flushing interval T1 is set to be long. This structure reduces the number of times the periodic flushing, which delays the ink ejection for printing, is performed. As a result, the efficiency of the printing process is improved.

(4) In the above embodiment, marginless printing of the printer 10 is controlled with a simpler structure that does not include the marginless flushing timer 47*b*.

A third embodiment of the present invention will now be described with reference to FIGS. 10 to 12. The printer 10 of the third embodiment has a main structure that is the same as that in the above embodiments and will not be described. The third embodiment will be described focusing on control that differs from the control in the above embodiments. In the first embodiment described above, the ROM 42 prestores the data showing the correspondence between the marginless flushing interval T2 and the periodic flushing interval T1 (refer to. FIG. 8). In the third embodiment, the ROM 42 does not store the data shown in FIG. 8 and instead stores a management table Ta2 showing modes of flushing that are set based on the carriage stop time T3 immediately before a carriage 16 starts reciprocating and the elapsed time T4 from when the periodic flushing is performed previously. Accordingly, a CPU 41 does not have the periodic flushing timer 47*a* and the marginless flushing timer 47*b*, and instead has an elapsed time timer 47*c* (refer to FIG. 3) and a stop time timer 47*d* (refer to FIG. 3). The elapsed time timer 47*c* measures the elapsed time T4 from when the periodic flushing is performed previously. The stop time timer 47d measures the stop time T3 of the carriage 16 immediately before the carriage 16 starts reciprocating.

As shown in FIG. 11, in the present embodiment, the management table Ta2 sets a mode of flushing for every combination of the stop time T3 of the carriage 16 immediately before the carriage 16 starts reciprocating and the elapsed time T4 from when the periodic flushing is performed previously. The management table Ta2 sets the marginless flushing as the flushing to be performed normally. The management table Ta2 further sets a mode of the marginless flushing by setting the flushing frequency k per marginless flushing operation (number in parentheses in FIG. 11). The flushing frequency is set larger as the carriage stop time T3 is longer or the elapsed time T4 is longer. When the flushing frequency exceeds eight, the marginless flushing is not set but the periodic flushing is set.

For example, when the elapsed time T4 is less than five (block A) and the stop time T3 of the carriage 16 is less than 0.5 (block 1), the marginless flushing with the flushing frequency being zero is set. The flushing frequency being zero indicates that the marginless flushing is not actually performed although the marginless flushing is selected. For example, when the elapsed time T4 is greater than or equal to five and less than ten (block B) and the stop time T3 of the carriage 16 is greater than or equal to two and less than five (block 4), the marginless flushing with the flushing frequency being eight is set. In the present embodiment, the stop time T3 and the elapsed time T4 are categorized in predetermined time blocks, and an appropriate mode of the marginless flushing or the periodic flushing considering the stop time T3 and the elapsed time T4 is selected.

Figure 10:
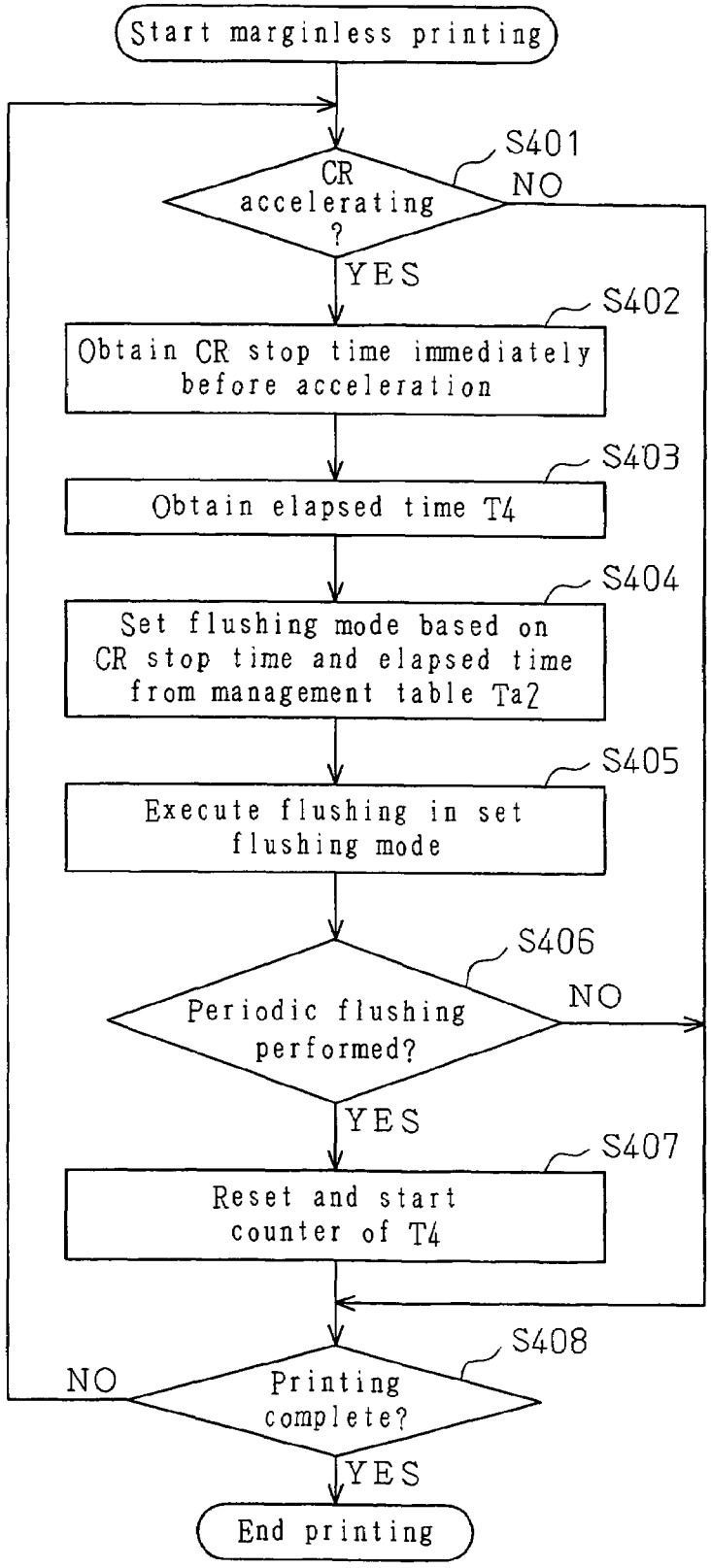
FIG. 10 is a flowchart showing the control for marginless flushing and periodic flushing in the third embodiment.

As shown in FIG. 10, when marginless printing is started, the CPU 41 (and the ASIC 45) determines whether the carriage 16 is accelerating (whether the carriage 16 has started accelerating) (S401). When the carriage 16 is accelerating (S401: YES), the CPU 41 (and the ASIC 45) obtains the stop time T3 of the carriage 16 immediately before the carriage 16 started accelerating from the stop time timer 47d (S402). Next, the CPU 41 (and the ASIC 45) obtains the elapsed time T4 from when the periodic flushing was performed previously from the elapsed time timer 47*c* (S403). Then, the CPU 41 reads the management table Ta2 stored in the ROM 42 and sets a predetermined mode of flushing based on the obtained stop time T3 and elapsed time T4 (S404). The setting of the mode of flushing will later be described in detail with reference to a timing chart showing one processing example.

Next, the flushing in the set mode is performed (S405). After the flushing is performed, the CPU 41 (and the ASIC 45) determines whether the periodic flushing has been performed (S406). When the periodic flushing has been performed (S406: YES), the elapsed time T4 from when the periodic flushing was performed previously and obtained from the elapsed time timer 47*c*, is cleared. Further, the elapsed time timer 47*c* is restarted.

The CPU 41 (and the ASIC 45) determines whether printing has been completed (S408). When printing has been completed (S408: YES), the flushing process ends. When printing has not been completed (S408: NO), the processing returns to the determination as to whether the carriage 16 is accelerating (S401), and the routine is repeated until printing is completed. When the carriage 16 is not accelerating (S401: NO), the CPU 41 (and the ASIC 45) determines whether printing has been completed (S408). The subsequent processing is the same as the processing described above.

The specific processing performed during one printing operation based on the above flowchart will now be described with reference to the timing chart shown in FIG. 12. In FIG. 12, each trapezoidal shape shown at the top row indicates the operating status of the carriage 16. The left side (upward sloping part) of the trapezoidal shape indicates that the carriage 16 is accelerating as it moves. The top side (horizontal part) of the trapezoidal shape indicates that the carriage 16 is moving at a constant velocity. The right side (downward sloping portion) of the trapezoidal shape indicates that the carriage 16 is decelerating as it moves. In the present embodiment, the marginless flushing shown at the bottom row in FIG. 12 is performed when the carriage 16 starts accelerating (at the left side of the trapezoidal shape) before reaching the paper P.

Figure 12:
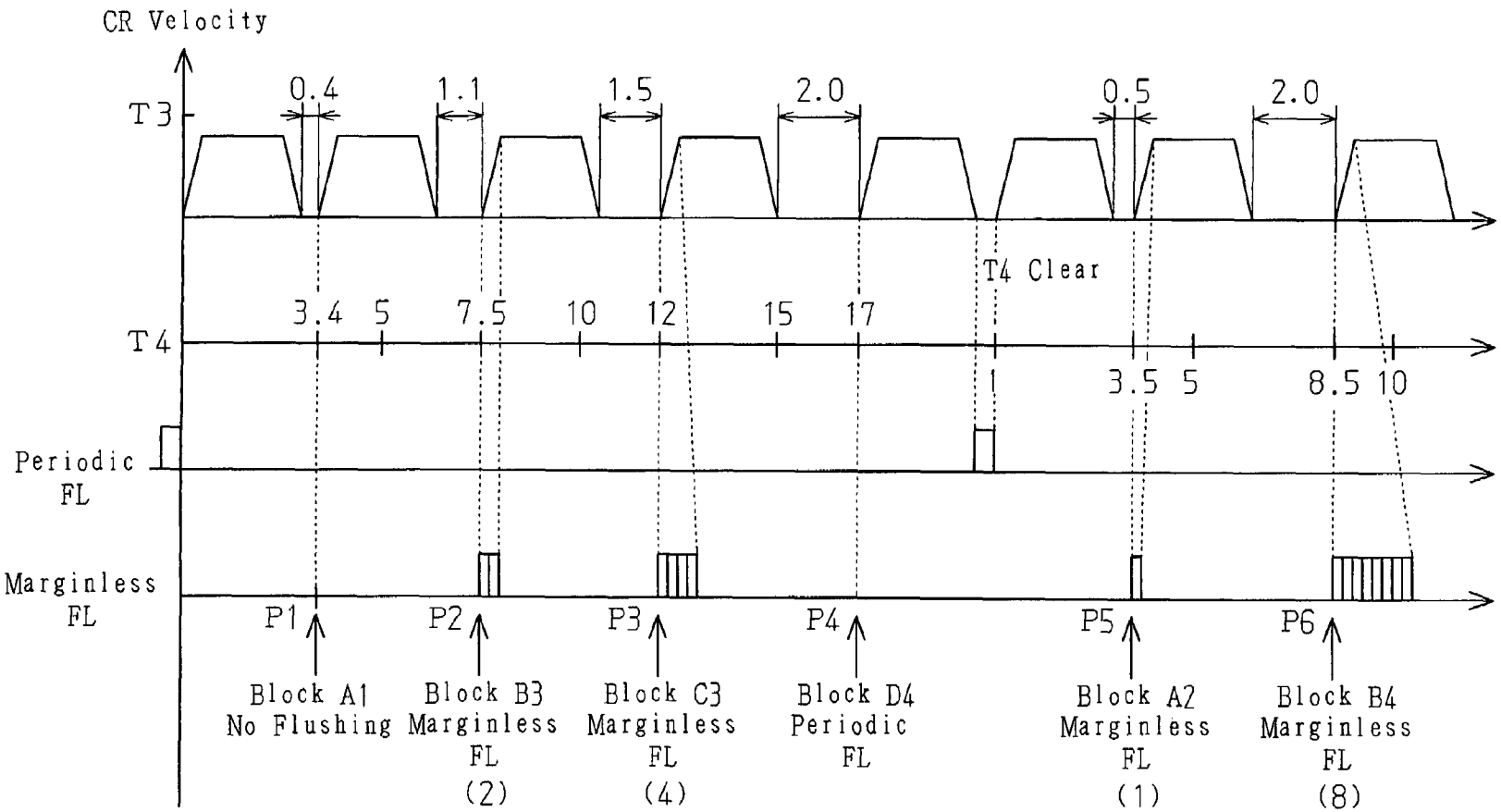
FIG. 12 shows a timing chart taken during printing.

As shown in FIG. 12, at a first acceleration point P1 at which the carriage 16 starts accelerating after printing is started, the elapsed time T4 is 3.4 seconds (T4<5 in block A) and the stop time T3 of the carriage 16 is 0.4 seconds (T3<0.5 in block 1). In this case, the marginless flushing with the flushing frequency being zero is set based on the management table Ta2 shown in FIG. 11. Since the flushing frequency is zero, the marginless flushing is not actually performed.

At a second acceleration point P2 at which the carriage 16 starts accelerating, the elapsed time T4 is 7.5 seconds (5≦T4<10 in block B) and the stop time T3 of the carriage 16 is 1.1 seconds (1.0≦T3<2.0 in block 3). In this case, the marginless flushing with the flushing frequency being two is set and performed based on the management table Ta2 shown in FIG. 11.

At a third acceleration point P3 at which the carriage 16 starts accelerating, the elapsed time T4 is 12 seconds (10≦T4<15 in block C) and the stop time T3 of the carriage 16 is 1.5 seconds (1.0≦T3<2.0 in block 3). In this case, the marginless flushing with the flushing frequency being four is set and performed based on the management table Ta2 shown in FIG. 11.

At a fourth acceleration point P4 at which the carriage 16 starts accelerating, the elapsed time T4 is 17 seconds (15≦T4<20 in block D) and the stop time T3 of the carriage 16 is 2.0 seconds (2.0≦T3<5.0 in block 4). In this case, the periodic flushing is set and performed based on the management table Ta2 shown in FIG. 11.

The periodic flushing is performed at the acceleration point P4. Then, the elapsed time T4 from the previous periodic flushing obtained from the elapsed time timer 47*c* is cleared, and the elapsed time timer 47*c* is restarted (S406 and S407 in FIG. 10).

At a fifth acceleration point P5 at which the carriage 16 starts accelerating, the elapsed time T4 is 3.5 seconds (T4<5 in block A) and the stop time T3 of the carriage 16 is 0.5 seconds (0.5≦T3<1.0 in block 2). In this case, the marginless flushing with the flushing frequency being one is set and performed based on the management table Ta2 shown in FIG. 11.

At a sixth acceleration point P6 at which the carriage 16 starts accelerating, the elapsed time T4 is 8.5 seconds (5≦T4<10 in block B) and the stop time T3 of the carriage 16 is 2.0 seconds (2.0≦T3<5.0 in block 4). In this case, the marginless flushing with the flushing frequency being eight is performed and performed based on the management table Ta2 shown in FIG. 11.

The third embodiment has the advantages described below.

(5) As described in the first and second embodiments, the marginless flushing is normally performed sequentially while the carriage 16 is accelerating (or decelerating in certain cases) after the marginless flushing interval T2 elapses. However, depending on the amount of data used for a single printing operation, the carriage 16 may be stopped during the printing operation for a certain time to process data. When the carriage 16 is stopped for a long time, the marginless flushing may not be performed at the preset marginless flushing interval T2. In other words, the actual marginless flushing interval may be longer than the preset marginless flushing interval T2. In this case, the flushing may fail to enable a sufficient amount of ink to be ejected.

However, in the present embodiment, each mode of flushing considers the stop time T3 of the carriage 16 as a marginless flushing interval parameter (in-range flushing interval parameter), which is a factor for changing the marginless flushing interval T2. This prevents insufficient flushing (insufficient ink ejection amount), which may be caused depending on the amount of print data when the carriage 16 is stopped and the marginless flushing interval T2 changes. As a result, the flushing is performed in a reliable manner in the appropriate mode.

(6) In the above embodiment, the flushing frequency k of the marginless flushing is set to increase as the carriage stop time T3 becomes longer or the elapsed time T4 becomes longer. In this way, when there is a possibility of a decrease in the amount of ink ejected for flushing as the predetermined time elapses from when the previously flushing, the flushing frequency k per marginless flushing operation is increased so that more ink is ejected by the marginless flushing. As a result, the ink in the nozzles 22 of the recording head 21 is ejected in a reliable manner.

(7) In the above embodiment, the management table Ta2 shown in FIG. 11 basically sets the marginless flushing. However, when the flushing frequency of the marginless flushing exceeds eight depending on the elapsed time T4 and the stop time T3, the periodic flushing is set instead of the marginless flushing. More specifically, the marginless flushing, which does not prolong the printing process time, is normally performed, and the periodic flushing is performed only when a large amount of ink that cannot be ejected by the marginless flushing needs to be ejected. This enables a sufficiently large amount of ink to be ejected in a reliable manner without lowering the printing efficiency.

(8) In the above embodiment, the marginless flushing and the periodic flushing are performed in combination during marginless flushing. Thus, when the marginless flushing is performed, the periodic flushing interval may be extended. This prevents the printing process time from increasing.

The above embodiments may be modified in the following forms.

In the first and second embodiments, a parameter for determining a mode of the marginless flushing or a mode of the periodic flushing may be, for example, the flushing frequency, the total flushing frequency, or the total amount of ink ejected by flushing.

More specifically, when, for example, the total amount of ink ejected by the marginless flushing is large, the periodic flushing interval T1 may be set to be longer as compared with when the total amount of ink ejected by the marginless flushing is small. Alternatively, instead of changing the periodic flushing interval T1, the flushing frequency per periodic flushing operation or the total amount of ink ejected by the periodic flushing may be set to be small.

Further, two or more of the above parameters may be used in combination. For example, a management table Ta3 shown in FIG. 13 sets a shorter periodic flushing interval T1 for a longer marginless flushing interval T2 (in the same manner as in the first embodiment), and sets a larger flushing frequency k per marginless flushing operation for a longer marginless flushing interval T2. Although there is a possibility of the amount of ink ejected by the marginless flushing decreasing when the marginless flushing interval T2 is long, this structure increases the flushing frequency. k per marginless flushing operation so as to increase the amount of ink ejected by the marginless flushing. This structure enables a sufficiently large amount of ink to be ejected in a more reliable manner as compared with the first embodiment described above.

In the first and second embodiments, the flushing is performed whenever the printing of a single print path is performed. However, the marginless flushing may be performed whenever the printing of two print paths is performed. Alternatively, the marginless flushing may be performed at longer intervals.

In the third embodiment, a management table Ta4 shown in FIG. 14 may be used instead of the management table Ta2 when the temperature in the ambient environment of the printer 10 (the temperature of the surrounding atmosphere of the recording head 21) is higher than in normal cases, for example, 31° C. or higher. To increase the amount of ejected ink compared to the management table Ta2, the management table Ta4 sets a larger flushing frequency k or sets the periodic flushing. This is because the ink easily dries and the nozzles 22 are likely to be clogged when the temperature of the ambient environment is high. In this way, the ROM 42 may store the management table Ta2 and the management table Ta4, and an appropriate one of the management table Ta2 and the management table Ta4 may be used in accordance with the temperature of the ambient installment that is detected by a temperature sensor (not shown). This structure ensures that the nozzles 22 are prevented from being clogged by ink in a further optimal manner.

The above modification has the same advantages as the first and second embodiments. More specifically, in the first and second embodiments, the control programs may be preset in a manner that the flushing frequency (or the ink ejection amount) per marginless flushing operation is larger when the temperature in the installment environment (the temperature of the surrounding atmosphere of the recording head 21) higher than normal.

In the third embodiment, the paper size (including the standardized sizes, such as A4 and B5, or the width dimension of the paper in the printing direction) may be used as the marginless flushing interval parameter (in-range flushing interval parameter). In this case, the stop time T3 of the carriage 16 in FIG. 11 is replaced by the paper size, and the flushing frequency of the marginless flushing is increased as the paper size becomes larger.

The marginless flushing is performed when the carriage 16 is accelerating. Thus, when the paper size is large, the time required for the printing of a single print path is long. Thus, even when the marginless flushing interval T2 is preset, the marginless flushing may fail to be performed at the set interval and the actual marginless flushing interval may be longer than the preset interval in the same manner as when the carriage 16 is stopped. As a result, a sufficiently amount of ink may not be ejected for flushing. When the paper size is set as a marginless flushing interval parameter (in-range flushing interval parameter), insufficient flushing (insufficient ink ejection amount), which may be caused when the marginless flushing interval changes, is prevented. As a result, the flushing is performed in the appropriate mode in an ensured manner.

The paper size and the stop time T3 of the carriage 16 in the third embodiment may be used in combination to set each mode of flushing.

The management table Ta2 of the third embodiment described above may set the total ink ejection amount instead of the flushing frequency k of the marginless flushing.

The management table Ta2 of the third embodiment may categorize the elapsed time T4 and the stop time T3 into predetermined periods of time and may set the appropriate mode of flushing accordingly.

In the third embodiment described above, the flowchart shown in FIG. 10 is a mere example. The order in which the steps are performed should not be limited to the order shown in the flowchart. For example, the step of obtaining the stop time T3 of the carriage 16 (S402) and the step of obtaining the elapsed time T4 (S403), the step of performing the flushing (S405), and the step of determining whether the periodic flushing has been performed and the step of resetting and starting counting of the elapsed time T4 (S406 and S407) may be performed in an order differing from the order shown in the flowchart in FIG. 10.

In the above embodiments, the ROM 42 functions as the storage portion. Alternatively, the RAM 43 may function as the storage portion.

In the above embodiments, the ink absorption members 32 arranged in the grooves 29 and the ink absorption member 34 arranged in the ink reception portion 33 absorb ink. However, these ink absorption members do not have to be used. The advantages equivalent to advantages (1) to (8) described above are also obtained in this case.

In the above embodiments, the present invention is embodied as the flushing performed during marginless printing. However, the present invention may be embodied as flushing performed for printing on a paper P, which serves as a target, having margins in the edge. In this case, the flushing is performed during a period from when the carriage 16 starts moving to perform printing to when the nozzles 22 that perform flushing are arranged above the paper P. More specifically, the flushing is performed in an area outside the paper P in the reciprocation range of the carriage 16 during ink ejection from the recording head 21. In this case, it is preferable that the liquid ejection apparatus include a groove or an ink absorption member for receiving the ink at a position that is outside the paper P and located at the end of the reciprocation range S of the carriage 16.

In the above embodiments, the present invention is embodied in the on-carriage inkjet printer including the ink cartridges 23 and 24 that are set on the carriage 16. However, the application of the present invention should not be limited to this type of printer, and the present invention may also be embodied in an off-carriage inkjet printer.

In the above embodiments, the printer 10 for ejecting ink is described as the liquid ejection apparatus. However, the present invention may be embodied in liquid ejection apparatuses other than the printer 10. Liquid ejection apparatuses other than the printer 10 may be printing apparatuses including a facsimile and a copier, liquid ejection apparatuses for ejecting other liquids, such as an electrode material and a color material for use in manufacturing an LCD (liquid crystal display), an EL (electroluminescence) display, or a surface emitting display, or liquid ejection apparatuses for ejecting living organisms for use in manufacturing a biochip, or a sample ejection apparatus as a precision pipette. Further, the liquid should not be limited to ink, but may be a liquid other than ink.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A liquid ejection apparatus for ejecting liquid toward a target, the apparatus comprising:

a liquid ejection head, mounted on a carriage that reciprocates, for ejecting the liquid toward the target; and a controller for controlling a flushing mode of an in-range flushing, performed during the ejection by the liquid ejection head in a reciprocation range of the carriage outside the target, and a flushing mode of an out-of-range flushing, performed during the ejection by the liquid ejection head outside the reciprocation range of the carriage when the liquid ejection head ejects the liquid as the carriage reciprocates, wherein the in-range flushing is flushing performed during marginless printing, and wherein the out-of-range flushing is flushing performed during the marginless printing outside the reciprocation range of the carriage.

2. The liquid ejection apparatus according to claim 1, further comprising:

a storage portion for storing a parameter for determining the flushing mode of the in-range flushing and a parameter for determining the flushing mode of the out-of-range flushing, with the parameters associated with each other, wherein the controller controls the flushing mode of the in-range flushing and the flushing mode of the out-of-range flushing based on the parameters stored in the storage port ion.

3. The liquid ejection apparatus according to claim 2, wherein the parameter for determining the flushing mode of the in-range flushing and the parameter for determining the mode of the out-of-range flushing differ depending on the temperature of the ambient environment of the liquid ejection head.

4. The liquid ejection apparatus according to claim 2, wherein each of the parameters is defined by at least one selected from a group consisting of a flushing interval, a flushing number, a flushing frequency, and a total ejection amount during flushing.

5. The liquid ejection apparatus according to claim 1, further comprising:

an out-of-range flushing timer for measuring a flushing interval of the out-of-range flushing, wherein the controller sets the flushing interval measured by the out-of-range flushing timer based on a parameter for determining the flushing mode of the out-of-range flushing, and the controller controls the flushing mode of the out-of-range flushing based on the set flushing interval.

6. The liquid ejection apparatus according to claim 5, wherein the controller sets the flushing interval of the out-of-range flushing to be longer as the flushing number in the in-range flushing increases.

7. The liquid ejection apparatus according to claim 5, further comprising:

an in-range flushing timer for measuring a flushing interval of the in-range flushing, wherein:

the storage portion stores the flushing interval of each flushing so that the flushing interval measured by the out-of-range flushing timer becomes shorter as the flushing interval measured by the in-range flushing timer becomes longer; and the controller controls the flushing mode of each flushing based on the flushing intervals stored in the storage portion.

8. The liquid ejection apparatus according to claim 1, further comprising:

an elapsed time timer for measuring an elapsed time from the previous out-of-range flushing; and a storage portion for storing the flushing mode of the in-range flushing or the out-of-range flushing associated with a combination of the elapsed time measured by the elapsed time timer and an in-range flushing interval parameter, which is a factor for changing a flushing interval of the in-range flushing, wherein the controller controls the flushing mode each flushing based on the flushing mode stored in the storage portion.

9. The liquid ejection apparatus according to claim 8, wherein:

the storage portion stores a flushing frequency for the flushing mode of the in-range flushing, and the flushing frequency is set to be larger as the value of the in-range flushing interval parameter becomes greater or as the elapsed time measured by the elapsed time timer becomes longer; and the controller controls the mode of the in-range flushing to be the flushing mode that is based on the flushing frequency stored in the storage portion when controlling the mode of the in-range flushing so as to perform the in-range flushing based on a combination of the elapsed time and the in-range flushing interval parameter.

10. The liquid ejection apparatus according to claim 9, wherein the flushing frequency of the in-range flushing differs depending on the ambient environment temperature of the liquid ejection head.

11. The liquid ejection apparatus according to claim 9, wherein the out-of-range flushing is selected instead of the in-range flushing when the flushing frequency of the in-range flushing exceeds a predetermined flushing frequency.

12. The liquid ejection apparatus according to claim 8, wherein the in-range flushing interval parameter is a stop time for the carriage immediately before the carriage staffs reciprocating or a size of the target to which the liquid is ejected.

13. A method for flushing of liquid ejection apparatus having a liquid ejection head, mounted on a carriage that reciprocates, for ejecting liquid toward a target, the method comprising:

determining a parameter for determining a flushing mode of an in-range flushing, performed during the ejection by the liquid ejection head in a reciprocation range outside the target, and a parameter for determining a flushing mode of an out-of-range flushing, performed during the ejection by the liquid ejection head outside the reciprocation range of the carriage; and performing both of the flushing mode of the in-range flushing and the flushing mode of the out-of-range flushing by associated the parameter for determining the flushing mode of the in-range flushing and the parameter for determining the flushing mode of the out-of-range flushing, wherein the in-range flushing is flushing performed during marginless printing, and wherein the out-of-range flushing is flushing performed during the marginless printing outside the reciprocation range of the carriage.

* * * * *